US005878823A

United States Patent [19]

Henriksson

[11] Patent Number: 5,878,823

[45] Date of Patent: Mar. 9, 1999

[54] HYDRAULIC BREAKING HAMMER

[75] Inventor: Stig Roland Henriksson, Nacka, Sweden

[73] Assignee: Atlas Copco Berema AB, Nacka, Sweden

[21] Appl. No.: 836,655

[22] PCT Filed: Nov. 17, 1995

[86] PCT No.: PCT/SE95/01370

§ 371 Date: May 16, 1997

§ 102(e) Date: May 16, 1997

[87] PCT Pub. No.: WO96/15881

PCT Pub. Date: May 30, 1996

[30] Foreign Application Priority Data

Nov. 17, 1994 [SE] Sweden ..... 9403977

[51] Int. Cl.[6] ..... B25D 9/04

[52] U.S. Cl. ..... 173/132; 173/210; 173/211; 173/128; 173/DIG. 2; 173/171; 279/19; 279/19.5

[58] Field of Search ..... 173/128, 132, 173/114, 133, 210, 211, DIG. 2, 171; 279/19, 19.3, 19.4, 19.5

[56] References Cited

U.S. PATENT DOCUMENTS

| | | | |
|---|---|---|---|
| 945,735 | 1/1910 | Hardsocg | 279/19 |
| 1,007,295 | 10/1911 | Lane | 279/19.5 |
| 1,591,377 | 7/1926 | Hansen | 173/211 |
| 1,808,452 | 6/1931 | Cousins | 173/128 |
| 4,133,394 | 1/1979 | Wohlwend | 173/139 |
| 5,388,842 | 2/1995 | Piras | 279/19.5 |
| 5,419,404 | 5/1995 | Niemi | 173/171 |
| 5,702,112 | 12/1997 | Brannstrom | 279/19 |

FOREIGN PATENT DOCUMENTS

| | | | |
|---|---|---|---|
| 522344 | 1/1993 | European Pat. Off. | 173/128 |
| 27 54 489 A1 | 6/1978 | Germany . | |
| 0 166 381 | 5/1986 | United Kingdom . | |

*Primary Examiner*—Scott A. Smith
*Assistant Examiner*—James P. Calve
*Attorney, Agent, or Firm*—Frishauf, Holtz, Goodman, Langer & Chick

[57] ABSTRACT

A hydraulic breaking hammer having a machine housing including a cylinder bore and an impact piston which is reciprocatingly movable in the cylinder bore in response to an alternating hydraulic pressure, and a tool part having: (i) a head portion fitted to a front portion of the machine housing, and (ii) a guide bore which lies in line with the cylinder bore and in which a breaking tool is slidably carried and repeatedly subjected to impact by the impact piston. A seal is arranged at the front portion of the machine housing between the cylinder bore and the impact piston for separating drive hydraulics of the breaking hammer from the tool part, and a transverse slot is formed in the front portion of the machine housing between mutually opposing side wall portions of the machine housing so as to intersect the cylinder bore forwardly of the seal. A plurality of lateral bores extend through the side wall portions of the machine housing and the head portion of the tool part, respectively, on both sides of the guide bore of the tool part, and a plurality of retainers are provided for locking the tool part to the machine housing when the retainers are inserted in respective ones of the lateral bores.

10 Claims, 2 Drawing Sheets

HYDRAULIC BREAKING HAMMER

BACKGROUND OF THE INVENTION

The present invention relates to hydraulic breaking hammers of the kind that comprise a machine housing which includes a cylinder bore and a reciprocatingly movable impact piston which moves backwards and forwards in said cylinder bore in response to alternating hydraulic pressure, a tool part which is fitted to the front of the machine housing and which has a guide bore which lies in line with the cylinder bore and in which a breaking tool is slidably carried and repeatedly subjected to impact by the impact piston as it moves, support means for aligning the breaking hammer mechanically in operation, and sealing means arranged in the front of the machine housing between the cylinder bore and the impact piston and functioning to separate the drive hydraulics of the breaking hammer from the tool part.

Breaking hammers of this kind are normally mounted on hydraulically operated carriers of different sizes, wherein the carrier hydraulics are also coupled to drive the breaking hammer, and wherein the breaking hammer is pivotally mounted on the outer end of a boom via the supports on said housing so as to be positioned mechanically by said boom in operation.

The machine housing of the breaking hammer is typically comprised of separate cylinder parts which embrace the impact piston, the seals and the valve system, and which are grouped axially in juxtaposed relationship and held tightly together by robust side bolts, so as to ensure that a seal is obtained between the cylinder parts against the high internal hydraulic working pressures. Side bolts and other screw fastener means, however, have certain drawbacks. The screw threads are shaken loose. In the case of side bolts, the wear and the corrosion that occurs in operation, together with micro-movements in the joints as a result of impacts and vibrations generated in the breaking hammer, cause the joints of the cylinder parts and their seals to be attacked by penetrating pressure oil and leakages and ultimately result in conditions which are hazardous both to the surroundings and to people in the vicinity of the work being carried out. Side bolts can also fracture, with serious consequences. In recent times, this insight into the hazards of side bolts has led to an endeavour to exclude side bolts from breaking hammer constructions. An example of one such endeavour is disclosed in International Publication WO 93/22106, PCT/SE93/00382.

Lightweight automotive carriers and short breaking hammers have been used in the demolition of derelict buildings, so as to be able to enter confined spaces more easily and to work therein more effectively. The hydraulic part of the machine housing forms the rear part of the breaking hammer and can therewith readily be made short and sufficiently robust to provide a long useful life, in the absence of side bolts. However, indoor demolition work results in an increase in laterally acting impacts, blows and breaking action, particularly against the breaking tool and against the tool part at the front of the housing, such that after being in operation for some length of time, the entire machine housing may be judged to be ineffective due to damage to the tool part. This is highly disadvantageous from the cost aspect, in view of the fact that the hydraulic part of the tool is expensive to produce and cannot be considered as being a spare part.

OBJECT OF THE INVENTION

With regard to hydraulic breaking hammers of the type concerned here, an object of the invention is to provide a breaking hammer which is better adapted for indoor demolition work and which has a front part or tool part which eliminates the need for side bolts and which also enables the longer useful life of the hydraulic part mounted in the machine housing to be used more effectively. The novel design of the tool part also enables the tool part to be exchanged quickly and easily when servicing the hammer, and also provides for better accessibility to the interior of the machine housing and reduces the centering requirement between the tool part and the machine housing. The novel mounting of the tool part in the machine housing also enables transmission of impact forces from the tool part to the machine housing to be dampened during hammer operation.

BRIEF DESCRIPTION OF THE DRAWINGS

The invention will now be described in more detail with reference to the accompanying drawings, in which.

DETAILED DESCRIPTION

Figure 1:
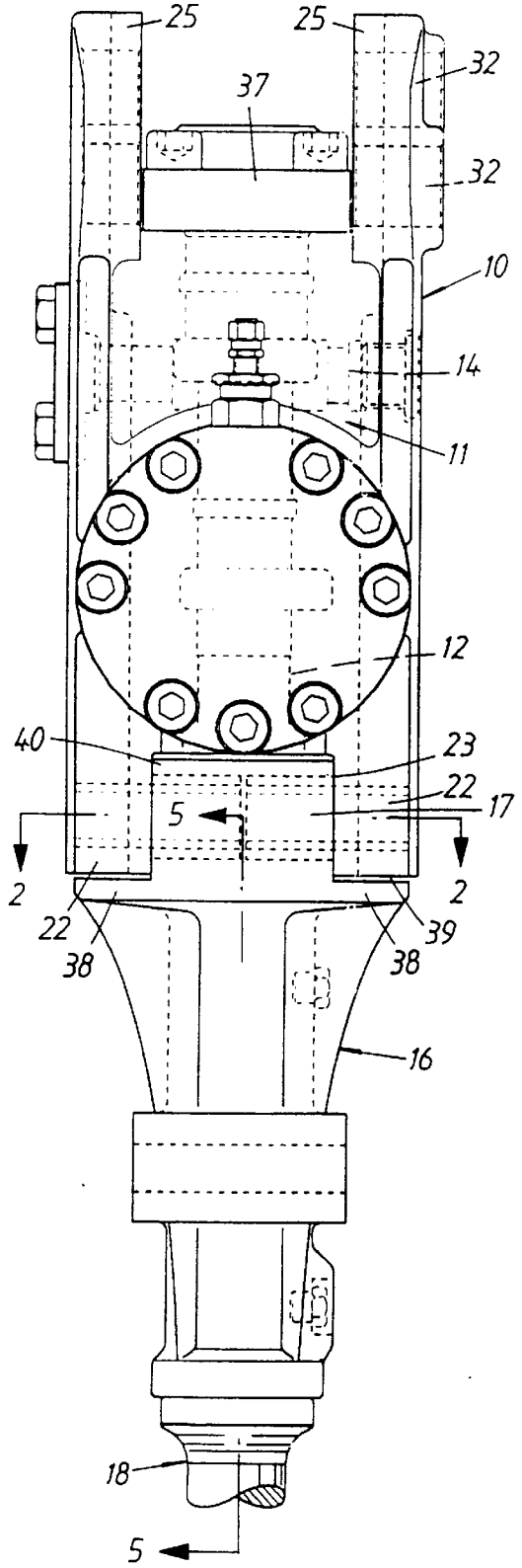
FIG. 1 illustrates an inventive breaking hammer from above.

The breaking hammer 10 shown in FIG. 1 includes a machine housing 11 and a tool part 16 which is fitted to the front of the housing 11. The tool part slidably carries a breaking tool 18, which is detachably retained in the guide bore 21 of said tool part 16 by means of locking retainers 33 (FIG. 5) and which has limited axial movement in the guide bore 21. The locking retainers 33 coact with recesses 35 provided in the breaking tool 18, and are insertable into lateral bores 34 in the tool part 16. The machine housing 11 carries at its rear end two supports 25 which include bores, indicated at 32, for pivotal connection to an automotive carrier (not shown), conveniently a lightweight carrier for building demolition purposes, and with a hydraulically operable boom for mechanical alignment of the breaking hammer 10 in the process of its work. The tool part 16 has a pointed or tapering configuration which enables the tool to work effectively and to reach into confined corners in demolition and cleaning operations.

Figure 5:
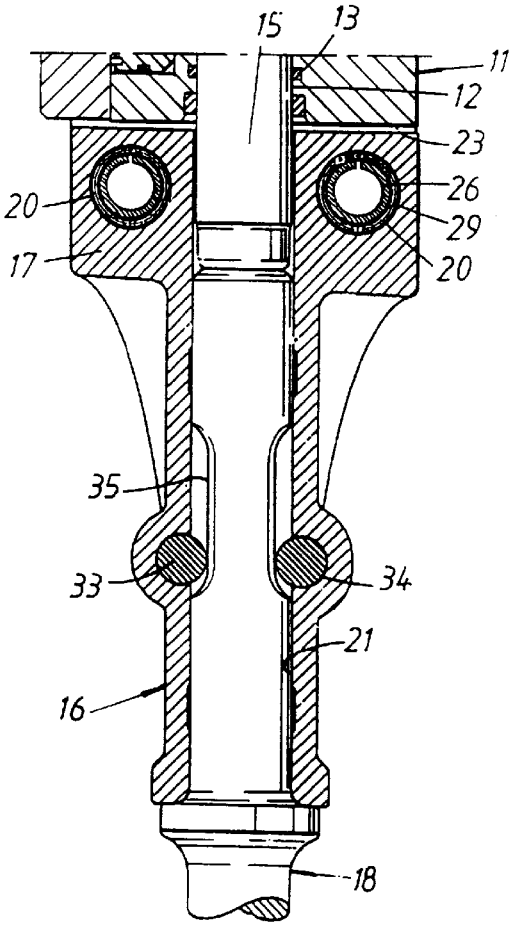
FIG. 5 is a longitudinal section view taken on the line 5—5 in FIG. 1.

The machine housing 11 also contains a cylinder bore 12 and a reciprocatingly movable impact piston or ram 15 which moves backwards and forwards in said bore in response to alternating hydraulic pressures delivered through the medium of a distributing valve bore 14, FIG. 5. The hydraulics used to drive the impact piston may have, in principle, any suitable known design, for instance may be slide-guided as described in the aforesaid publication WO 93/22106 and need not therefore be described here. The breaking hammer hydraulics are mounted in the interior of the machine housing and are held separate from the tool part 16 by seal 13 provided at the front end of the machine housing 11 and disposed around the front end of the impact piston 15. The cylinder bore 12 is sealed-off at its rear end by means of a cover plate 37 bolted to the rear end of the housing 11. The housing 11 is robust and made in one single piece from cast iron, including the supports 25.

Similar to the cover plate 37, the tool part 16 is carried by the machine housing 11 without the aid of side bolts or any other vibration-sensitive screw-threaded devices. To this end, the forward part of the machine housing 11 forms mutually parallel and mutually opposing side-wall parts 22 between which there extends a transverse slot 23 which intersects the cylinder bore 12 forwardly of the sealing means 13. Rearwardly of the locking retainers 33, the tool part 16 forms a head 17 which extends transversely to the guide bore 21 and which fits slidingly in and can be inserted between the side-wall parts 22, so that the guide bore 21 will be in alignment with the cylinder bore 12. The head 17 is provided with through-penetrating lateral-bores 20 on each side of the guide bore 21, and the side-wall parts 22 include lateral-bores 19 which are located coaxially with the lateral-bores 20 when the head 17 is fitted between the side-wall parts 22. When retainers 26, 27 are inserted through the lateral-bores 19, 20, there is obtained a robust attachment of the tool part 16 to the machine housing 11, wherein the tool attachment can be made and unmade both quickly and easily.

Figure 2:
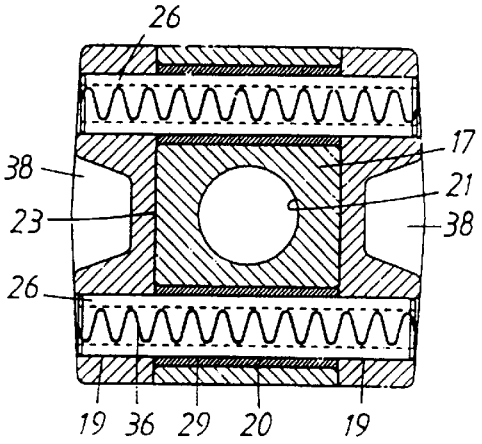
FIG. 2 is a cross-sectional view taken on the line 2—2 in FIG. 1.
Figure 3:
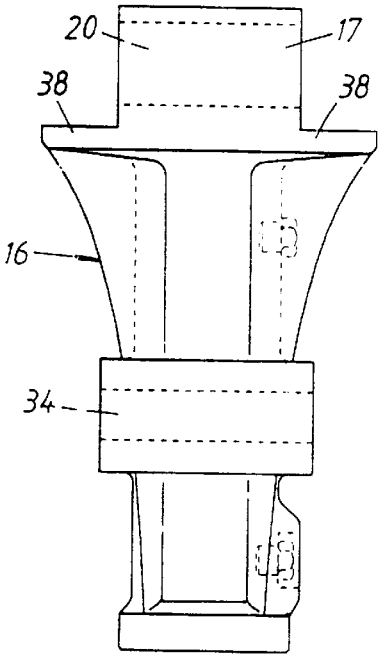
FIG. 3 is an isolated view of the tool part in FIG. 1 from above.
Figure 4:
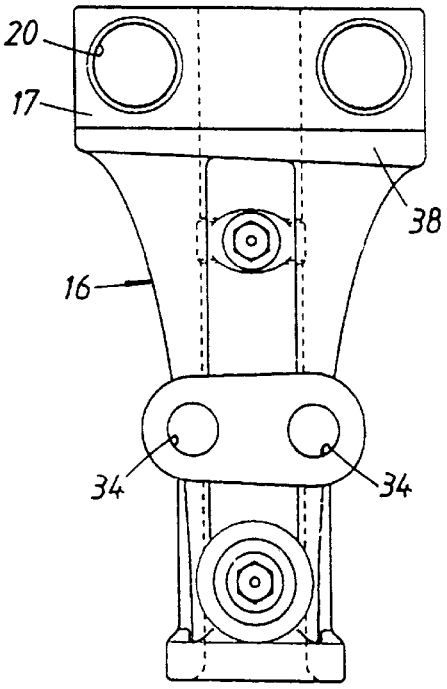
FIG. 4 is a side view of the tool part shown in FIG. 3.
Figure 6:
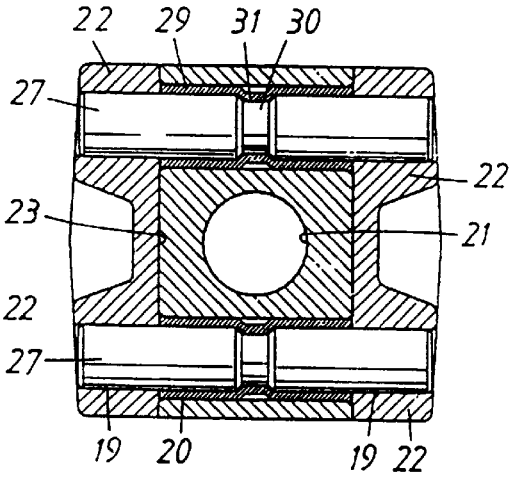
FIG. 6 is a view corresponding to FIG. 2 illustrating a modification of the tool part attachment.

In a simplified form, the lateral-bores 19, 20 can be made identical to one another and accommodate single retainers or, as indicated in FIG. 1, lengthwise divided retainers in direct metal to metal contact in the lateral-bores 19, 20 of the side-wall parts 22 and the head 17, as shown in FIGS. 2 and 6. However, the retainer attachment between the aforesaid parts can be used very conveniently to dampen vibrations. In this regard, the retainers 26, 27 are fitted with impact-damping plastic sleeves 29, at least in the lateral-bores 20 in the head 17, these lateral-bores being given a slightly larger diameter than the lateral-bores 19 so as to provide room for the sleeves 29. The sleeves will preferably be made of polyurethane, which affords a good vibration damping effect. It will be seen from FIGS. 1 and 5 that when the tool part 16 is inserted and secured by the retainers, gaps 39, 40 are formed between the bottom of the lateral slot or channel 23 and adjacent side-wall parts 22 and the head 17 and its adjacent end-walls 38. Due to the vibration-space in the gaps 39, 40, the plastic sleeves 29 are able to dampen occurrent impacts and prevent the transmission of impact forces to the machine housing 11 as a result of direct metallic contact.

In the case of the FIG. 2 embodiments, the retainers are cylinder and are slit along an undulating line 36 so as to form tensioning bushes 26 which press against the lateral-bores 19 and secure the retainers longitudinally against being shaken out from the bores while the hydraulic breaking hammer is in use. The retainers are preferably made from steel and are radially resilient.

In the case of the FIG. 6 embodiment, the solid steel retainers 27 include a circular groove 30 in the region of the sleeves 29. Correspondingly, the sleeves 29 are provided with an internal bead 31 which springs into the circular groove as the retainers 27 are fitted. Due to the differences in the diameters of the cross-bores 19, 20, the sleeve 29 and its bead 31 will hold the retainers 27 locked in position in the head 17 of the tool part 16 located between the side-wall parts 22 of the machine housing 11.

It will be observed that the construction does not require the impact piston 15 to be accurately centered in the guide bore 21 of the tool part 16. The impact piston 15 may simply lie in the guide bore and repeatedly strike against the breaking tool 18 with free play in said guide bore 21, to no disadvantage.

I claim:

1. A hydraulic breaking hammer comprising:

a machine housing including a cylinder bore and an impact piston which is reciprocatingly movable in said cylinder bore in response to an alternating hydraulic pressure;

a tool part having: (i) a head portion fitted to a front portion of said machine housing, and (ii) a guide bore which lies in line with said cylinder bore and in which a breaking tool is slidably carried and repeatedly subjected to impact by said impact piston;

a seal arranged at said front portion of said machine housing between said cylinder bore and said impact piston for separating drive hydraulics of said breaking hammer from said tool part;

a transverse slot formed in said front portion of said machine housing between mutually opposing side wall portions of said machine housing so as to intersect said cylinder bore forwardly of said seal;

a plurality of lateral bores extending through said side wall portions of said machine housing and said head portion of said tool part, respectively, on both sides of said guide bore of said tool part; and a plurality of retainers for locking said tool part to said machine housing when said retainers are inserted in respective ones of said lateral bores.

2. The hydraulic breaking hammer according to claim 1, further comprising impact-damping plastic sleeves fitted at least between said retainers and said head portion of said tool part, and wherein at least one gap is formed between mutually opposing surfaces of said machine housing and said tool part when said head portion of said tool part is locked to said machine housing.

3. The hydraulic breaking hammer according to claim 2, wherein a diameter of said lateral bores in said head portion of said tool part is greater than a diameter of said lateral bores in said side wall portions of said machine housing, and wherein said impact-damping plastic sleeves are fitted around said retainers in said head portion of said tool part.

4. The hydraulic breaking hammer according to claim 3, wherein said retainers comprise hollow cylinder bushes which are slotted along an undulating line and which exert a radially and outwardly acting force.

5. The hydraulic breaking hammer according to claim 3, wherein said retainers each comprise a solid member having a circular groove in a region of said impact-damping plastic sleeves, and wherein said impact-damping plastic sleeves each include an internal bead which springs into said solid groove of a respective one of said retainers to lock the respective one of said retainers between said side wall portions of said machine housing.

6. The hydraulic breaking hammer according to claim 2, wherein a front portion of said tool part includes at least one lateral bore for detachably receiving a locking retainer which together with lateral recesses provided on said breaking tool locks said breaking tool in said tool part while limiting axial movement of said breaking tool in said tool part.

7. The hydraulic breaking hammer according to claim 2, wherein said at least one gap comprises a gap formed at a bottom portion of said lateral slot.

8. The hydraulic breaking hammer according to claim 7, wherein said at least one gap further comprises a gap formed adjacent to said side wall portions of said machine housing.

9. The hydraulic breaking hammer according to claim 2, wherein said impact-damping plastic sleeves comprise polyurethane sleeves.

10. The hydraulic breaking hammer according to claim 1, wherein said guide bore of said tool part is adapted to accommodate said impact piston with a given clearance.

* * * * *

UNITED STATES PATENT AND TRADEMARK OFFICE

CERTIFICATE OF CORRECTION

PATENT NO. : 5,878,823

DATED : March 9, 1999

INVENTOR(S) : Stig Roland HENRIKSSON

It is certified that error appears in the above-identified patent and that said Letters Patent is hereby corrected as shown below: On the title page:

Item [56] References Cited, under "FOREIGN PATENT DOCUMENTS" change "0 166 381" to --2 166 381--.

Signed and Sealed this

Twentieth Day of June, 2000

*Attest:*

Q. TODD DICKINSON

*Attesting Officer*

*Director of Patents and Trademarks*